US005303131A

United States Patent [19]

Wu

[11] Patent Number: 5,303,131

[45] Date of Patent: Apr. 12, 1994

[54] SHOE WARNING LIGHT DEVICE

[76] Inventor: Andy Wu, No. 10, Lane 139, Sec. 1, Chain-Pin Rd., Taichung, Taiwan

[21] Appl. No.: 109,907

[22] Filed: Aug. 23, 1993

[51] Int. Cl.[5] ..... F21L 15/08

[52] U.S. Cl. ..... 362/103; 362/191; 362/200; 36/137

[58] Field of Search ..... 362/103, 190, 191, 200, 362/208, 253, 800; 36/137

[56] References Cited

U.S. PATENT DOCUMENTS

| | | | |
|---|---|---|---|
| 3,800,133 | 3/1974 | Duval | 362/103 |
| 3,946,505 | 3/1976 | Dana, III | 362/103 |
| 4,848,009 | 7/1989 | Rodgers | 362/103 X |
| 5,188,447 | 2/1993 | Chiang et al. | 362/103 |

*Primary Examiner*—Stephen F. Husar
*Attorney, Agent, or Firm*—Browdy and Neimark

[57] ABSTRACT

A shoe warning light device comprises: a fastening seat having a holding space and disposed in a shoe midsole such that the front wall of the fastening seat is exposed; a luminous body fastened to the front wall of the fastening seat and provided with two polar feet extending into the holding space to form two conducting connections; a housing mounted detachably in the holding space and provided in the top wall thereof with a U-shaped slot forming a flexible tongue; two conducting pieces provided respectively with one end forming a power source connection engageable with one of the two conducting connections, with one of the two conducting pieces extending downwards to locate over the bottom wall of the housing, and with another one of the two conducting pieces extending upwards to locate under the tongue; and a battery disposed in the housing such that it is in contact with one of the two conducting pieces.

9 Claims, 3 Drawing Sheets

SHOE WARNING LIGHT DEVICE

FIELD OF THE INVENTION

The present invention relates generally to a warning light device, and more particularly to a shoe warning light device.

BACKGROUND OF THE INVENTION

Some people like to engage in walking or jogging as a form of exercise after dark or before dawn, thereby making themselves vulnerable to a traffic accident or death. It is therefore suggested that such exercisers as mentioned above should wear a pair of shoes having a reflector or a fluorescent device attached thereto as a means of warning the drivers. However, the reflector is generally effective only at the time when the beams of light coming from a motor vehicle are projected on the reflector appropriately. The effect of the fluorescent device is generally poor after dark or before dawn, because the fluorescent device is most effective in a place where it is very dark.

SUMMARY OF THE INVENTION

It is therefore the primary objective of the present invention to provide a shoe warning light device capable of giving a warning light to caution a driver, so as to safeguard a person who wears the shoe.

It is another objective of the present invention to provide a shoe warning light device with an easily replaceable power source so as to prolong the service lifespan of the device.

It is still another objective of the present invention to provide a shoe warning light device with a power source which can be easily turned on or off, so as to save the energy of the device.

The foregoing objectives of the present invention are accomplished by a shoe warning light device, which comprises a fastening seat, a luminous body, a housing, two conducting pieces, and a battery. The fastening seat has a bottom wall having four peripheries from which a front wall, a rear wall, a left wall and a right wall are erected so as to form a holding space with an open top. The fastening seat is mounted in the midsole of a shoe, with its holding space being corresponding in location to the heel of a shoe wearer and with its front wall being exposed. The luminous body has two polar feet disposed in the front wall of the fastening seat. The two polar feet extend beyond the inner wall surface of the holding space to form two conducting connections. The housing has a receiving space formed by a top wall, a bottom ball, a front wall, a rear wall, a left wall and a right wall. The top wall is provided with a U-shaped slot forming a pliable tongue. The housing is detachably mounted in the holding space of the fastening seat such that the tongue of the housing can be caused to bend toward the receiving space by the treading of the heel of a shoe wearer. The two conducting pieces are respectively disposed at one end thereof beyond the front wall of the housing to form two power source connections capable of making contact with the two connections of the luminous body. One of the two conducting pieces extends downwards to locate over the bottom wall of the housing, while another one of the two conducting pieces extends upwards to locate under the tongue of the top wall of the housing such that it can move downwards along with the tongue. The battery is housed in the receiving space of the housing and between the two conducting pieces and is in contact with the lower conducting piece. There is a gap between the battery and the upper conducting piece. However, when the upper conducting piece moves downwards along with the tongue, the upper conducting piece makes contact with the battery so as to provide the luminous body with the power.

DETAILED DESCRIPTION OF THE INVENTION

Figure 1:
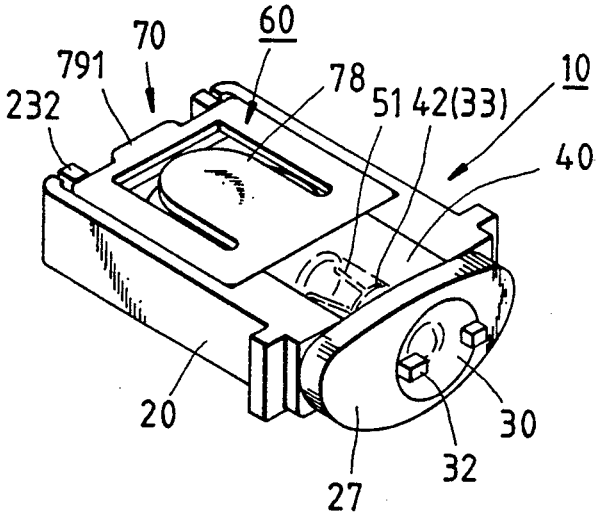
FIG. 1 shows a perspective view of the present invention.
Figure 2:
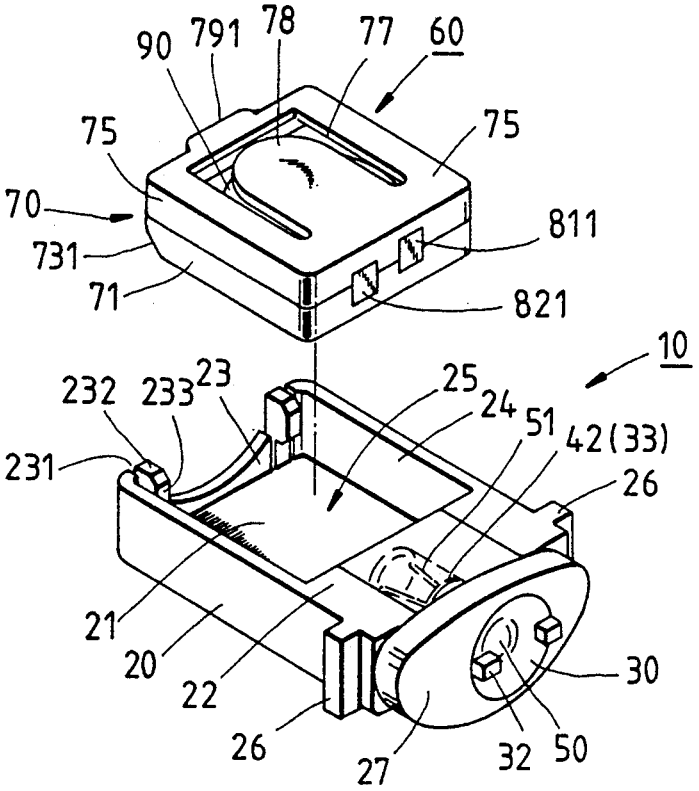
FIG. 2 is a partial exploded view of the present invention as shown in FIG. 1, illustrating a luminous unit and a power unit.
Figure 3:
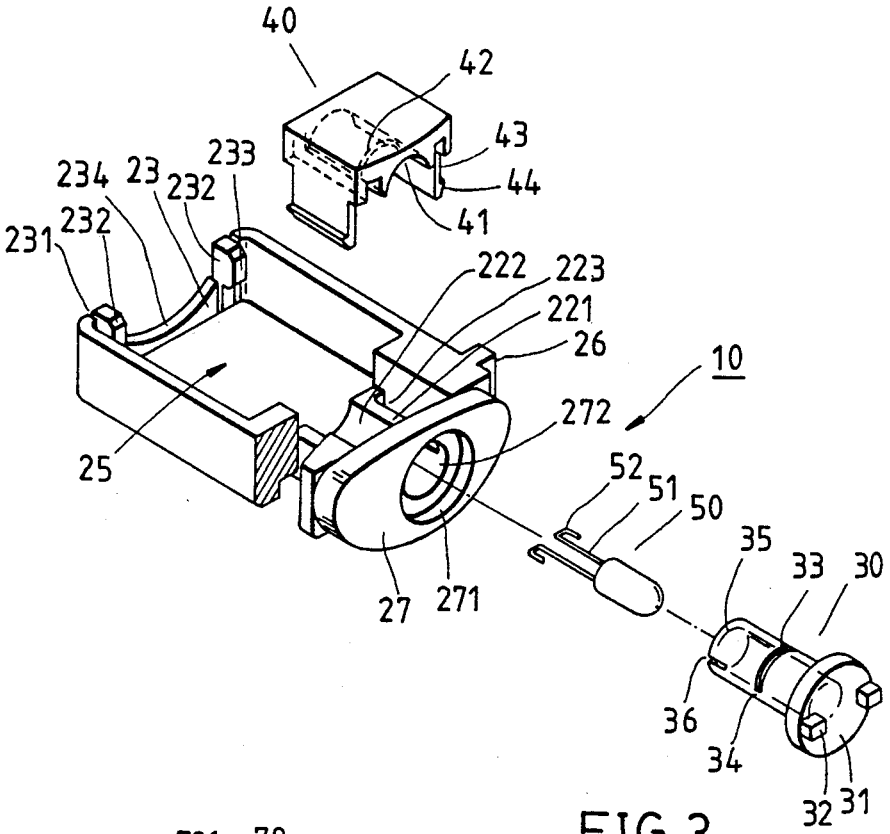
FIG. 3 shows an exploded view of the luminous unit as shown in FIG. 2.
Figure 4:
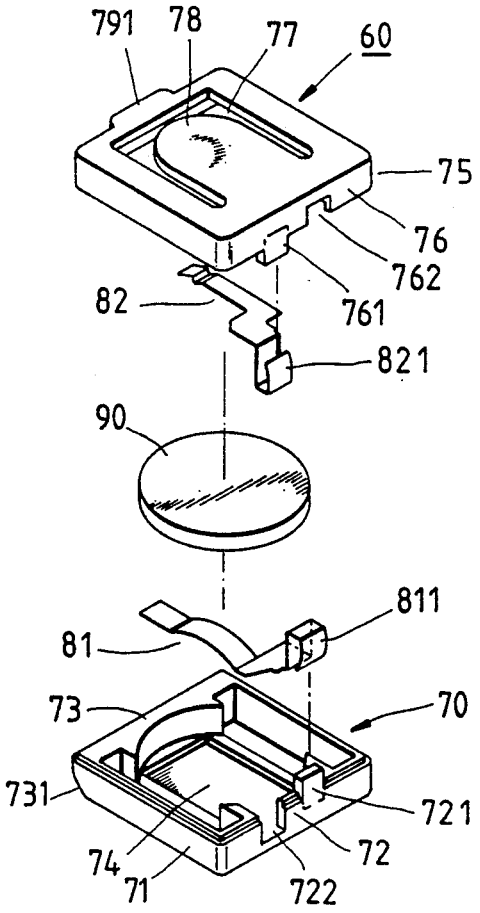
FIG. 4 shows an exploded view of the power unit as shown in FIG. 2.

As shown in FIGS. 1–4, the present invention is composed of a luminous unit 10 and a power source unit 60.

The luminous unit 10 comprises a fastening seat 20, a luminous body seat 30, a cover 10, and a luminous body 50.

The fastening seat 20 has a bottom wall 21 in addition to a front wall 22, a rear wall 23, a left wall and a right wall 24, which are erected respectively from the peripheries of the bottom wall 21, so as to form a holding space 25 having an open top. The front wall 22 is relatively thicker and provided respectively at both sides of a front surface thereof with a shoulder 26. The front surface of the front wall 22 is provided with a protruded, oval and arcuate face plate 27 having at the center thereof a round cavity 271 which in turn is provided centrally with a through hole 272. The front wall 22 is provided behind the face plate 27 with a recess 221 having a slot 222 cf a semi-cylindrical shape and corresponding in location to the through hole 272. The recess 221 is provided respectively at both sides thereof with a through hole 223. The rear wall 23 is provided at both sides thereof with two dents 231 parallel to each other. Each of the two dents 231 is provided with a flexible arm 232 having a projection 233 located at the upper portion of the inner side thereof. The rear wall 23 is provided with an arcuate dent 234 located between the two arms 232.

The luminous body seat 30 of slightly cylindrical construction is provided at the front end thereof with a circular stepped portion 31 which is in turn provided respectively at both sides of the front end thereof with a protruded portion 32. The seat 30 is provided along the circumference thereof with a recessed ring 33 having two ends which are not connected. The recessed ring 33 has a retaining portion 34 having at the rear end thereof a cell 35 along the axis thereof and toward the front end thereof. The retaining portion 34 is provided respectively at both sides of the rear end thereof with a small slot 36. The seat 30 is disposed pivotally in the through hole 272 of the face plate 27 such that its circular stepped portion 31 is received in the cavity 271.

The cover 40 has one side provided centrally with a slot 41 of semi-cylindrical construction and having an arcuate rib 42. The cover 40 is provided at both sides thereof with two feet 43 extending vertically and having an inverted hook 44. The two feet 43 are inserted into the two through holes 223 of the recess 221 such that the inverted hook 44 is retained. The slot 41 of the cover 40 and the slot 222 of the recess 221 form an axial hole to receive therein the cylindrical body of the seat 30. The arcuate rib 42 is inserted into the recessed ring 33 of the seat 30 so as to prevent the seat 30 from slipping out. The seat 30 can be so twisted that its retaining portion 34 engages the arcuate rib 42 of the cover 40. As a result, the seat 30 can be caused to turn for an angle of 90 degrees only.

The luminous body 50 has a diode and two polar feet 51 and is disposed in the cell 35 of the luminous body seat 30 in such a manner that the two polar feet 51 are retained securely in the two small slots 36 of the seat 30, and that two conducting connections 52 are formed on the rear side of the seat 30.

The power source unit 60 comprises a housing 70, and an upper and a lower conducting pieces 81 and 82, and a battery 90.

The housing 70 is composed of an upper casing 75 and a lower casing 71 of slightly square construction. The lower casing 71 is provided with a front wall 72 having a protuberance 721 and an indentation 722, and with a rear wall 73 having an inverted corner 731, and further with a receiving recess 74. The upper casing 75 has a front wall 76 with a protuberance 761 and an indentation 762 which are engageable respectively with the indentation 722 and the protuberance 721 of the lower casing 71. The upper casing 75 is provided in the wall thereof with a U-shaped slot 77 so as to form a flexible tongue 78 which can be caused to bend by the treading of the heel of a person. The rear wall 79 of the upper casing 75 is provided with a twisting projection 791. The upper and the lower casings 75 and 71 can be joined together by means of an adhesive, or an ultrasonic device, of a high frequency device, or a mortise and tenon joint.

The upper and the lower conducting pieces 82 and 81 are provided with the curved ends which are retained securely by the protuberances 721 and 761 of the housing 70. The upper and the lower conducting pieces 82 and 81 form in the front wall of the housing 70 two power source connections 821 and 811. The lower conducting piece 81 extends toward the lower portion of the inside of the housing 70 to locate over the bottom ball of the lower casing 71, while the upper conducting piece 82 extends toward the upper portion of the inside of the housing 70 so as to locate under the tongue 78 of the upper casing 75. The upper conducting piece 82 is capable of moving downwards along with the tongue 78.

The battery 90 is received in the receiving recess 74 of the housing 70 and between the two conducting pieces 81 and 82. The battery 90 is located securely by the upper and the lower casings 75 and 71 such that the battery 90 is in contact with the lower conducting piece 81 and that the battery 90 and the upper conducting piece 82 remain apart. When the upper conducting piece 82 moves downwards along with the tongue 78 so as to make contact with the battery 90, the luminous body 50 is thus provided with power.

The power source unit 60 is disposed in the holding space 25 of the luminous unit 10 such that the tongue 78 faces upwards and is supported by the projections 233 of the two arms 232 of the fastening seat 20, and that the two power source connections 811 and 821 are in contact with the two conducting connections 52 of the luminous body 50. The twisting projection 791 is located over the arcuate dent 234 and intended for use to lift open the housing 70 so as to remove therefrom the power source unit 60.

Figure 5:
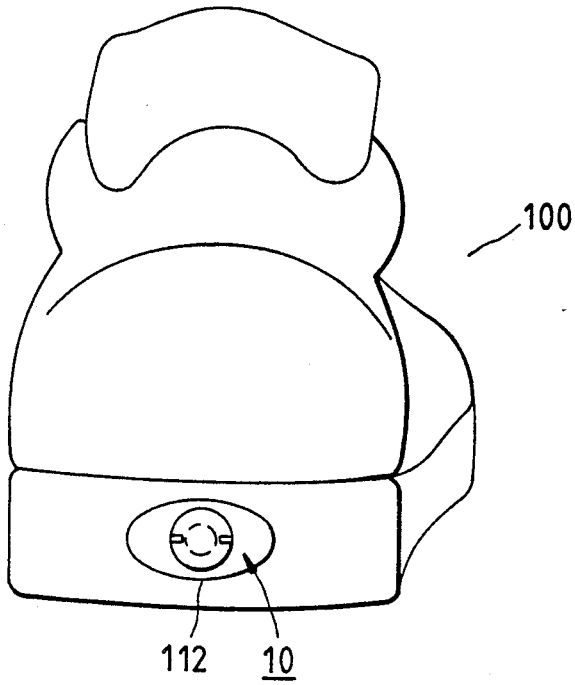
FIGS. 5–7 are schematic views of the present invention at work.
Figure 6:
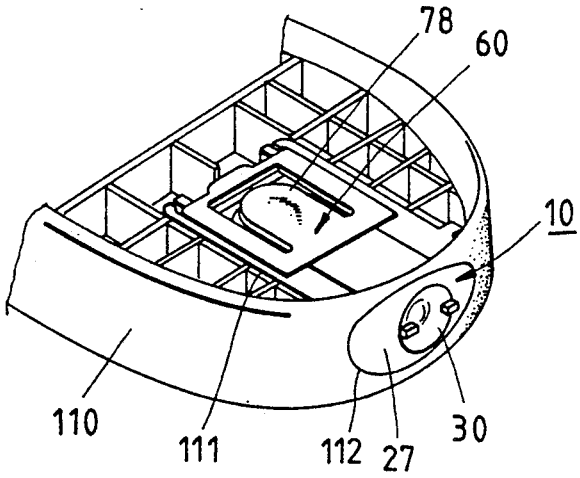
Figure 7:
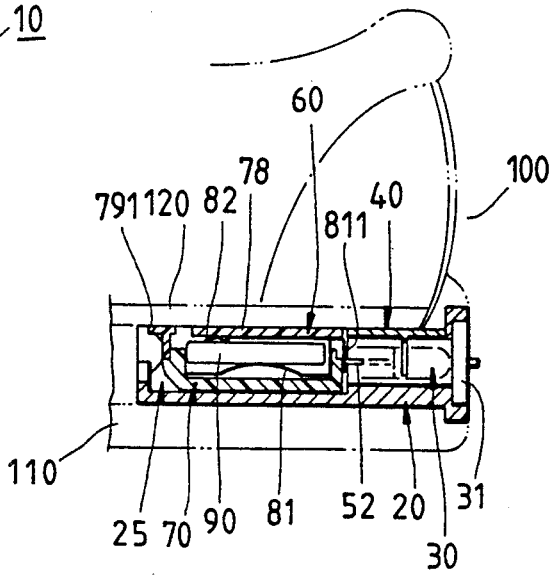

As shown in FIGS. 5-7, the midsole 110 of a shoe 100 is provided with a cavity 111 corresponding in location to the heel. The midsole 110 is provided at the rear end thereof with an oval through hole 112 in communication with the cavity 111 in which the fastening seat 20 of the luminous unit 10 is lodged. In the meantime, the arcuate face plate 27 is lodged in the cavity 111. The treading action of the heel exerts a pressure on the tongue 78, which is then caused to bend so as to force the upper conducting piece 82 to move downwards to make contact with the battery 90, thereby resulting in the luminous body 50 to give off light. As soon as the tongue 78 is relieved of the treading action of the heel, the tongue 78 is permitted to bounce back up to bring about the circuit breakup between the upper conducting piece 82 and the battery 90. As a result, the luminous body 50 stops emitting light. The present invention is therefore capable of sending out the warning light at short intervals to the operator of a motor vehicle at the time when the user of the present invention walks or jogs. The exhausted battery 90 is replaced by replenishing a new power source unit 60. In the daytime when the warning light is not called for, the circuit breakup between the two conducting connections 52 and the two power source connections 811 and 821 can be brought about by twisting the luminous body seat 30.

The fastening seat 20 is made of a transparent plastic or an acrylic resin. The arcuate face plate 27 of the fastening seat 20 is so designed to fit the midsole of a shoe. In addition, the arcuate face plate 27 is capable of making the warning light brighter and of causing the warning light to have a range of greater distance.

What is claimed is:

1. A shoe warning light device comprising:

a fastening seat having a bottom wall, a front wall, a rear wall, a left wall and a right wall, which form a holding space with an open top, said fastening seat being so dimensioned as to fit into a cavity of a shoe midsole such that said holding space of said fastening seat is corresponding in location to a person's heel, and that said front wall of said fastening seat is exposed;

a luminous body having two polar feet which extend to reach an inner wall surface of said holding space and to form two conducting connections;

a housing having a top wall, a bottom wall, a front wall, a rear wall, a left wall and a right wall, which form a receiving space, said top wall having a U-shaped slot forming a flexible tongue, said housing being detachably mounted in said holding space of said fastening seat such that said tongue can be caused to bend toward said receiving space by a treading action of said heel;

two conducting pieces fastened respectively at one end thereof with said front wall of said housing such that said two conducting pieces are exposed to form two power source connections capable of making contact with said two conducting connections of said luminous body, with one of said two conducting pieces extending downwards to locate over said bottom wall of said housing, and with another one of said two conducting pieces extending upwards to locate under said tongue of said top wall of said housing such that said another one of said two conducting pieces is capable of moving downwards along with said tongue; and a battery disposed in said receiving space of said housing and between said two conducting pieces such that said battery is in contact with a lower conducting piece, and that said battery remains apart with an upper conducting piece capable of moving downwards along with said tongue so as to make contact with said battery to provide said luminous body with a power source.

2. The shoe warning light device of claim 1 wherein said front wall of said fastening seat communicating said holding space and having a luminous body seat disposed therein pivotally such that a front end of said luminous body seat is exposed through said front wall of said fastening seat, and that a rear end of said luminous body seat is exposed to an inner wall of said holding space, and further that said luminous body seat can be twisted to make a turn for a predetermined angle for controlling a circuit connection and a circuit breakup between said two power source connections and said two conducting connections.

3. The shoe warning light device of claim 2 wherein said front wall of said fastening seat is provided with a recess having a semi-cylindrical slot; wherein said housing is disposed in said recess and provided with a semi-cylindrical slot forming said axial hole in conjunction with said semi-cylindrical slot of said recess of said fastening seat, with said axial hole receiving therein said luminous body seat; wherein said luminous body seat is provided along a circumference thereof with a recessed ring having two ends that are not connected and having a retaining portion; and wherein said slot of said housing is provided on an inner wall thereof with a rib corresponding in location to said recessed ring of said luminous body seat.

4. The shoe warning light device of claim 2 wherein said front wall of said fastening seat is provided with a face plate of a predetermined shape and having a through hole corresponding in location to said axial hole, said through hole having a front end of a greater diameter and forming therein a cavity; and wherein said luminous body seat is provided at a front end thereof with a round stepped portion of a greater diameter and having respectively on both sides thereof a protuberance, said luminous body seat being disposed pivotally in said through hole such that said round stepped portion is received in said cavity.

5. The shoe warning light device of claim 1 wherein said rear wall of said fastening seat is provided with two dents which are parallel to each other and are provided respectively with a flexible arm with a projection for supporting said housing in such a way that said two conducting connections can be caused to make an intimate contact with said two power source connections.

6. The shoe warning light device of claim 1 wherein said rear wall of said fastening seat is provided with an arcuate dent.

7. The shoe warning light device of claim wherein said housing comprising:

a lower casing having a front wall provided with a protuberance, an indentation, and a receiving recess; and an upper casing having a front wall provided with a protuberance and an indentation which are engageable with said protuberance and said indentation of said lower casing, said upper casing further having a U-shaped slot forming a flexible tongue;

wherein said lower casing and said upper casing are joined together to form said housing; wherein said protuberance of said lower casing and said protuberance of said upper casing retain respectively a curved end of each of said two conducting .pieces; wherein one of said two conducting pieces extends toward. a lower portion of an interior of said housing so as to located over a bottom wall of said lower casing; and wherein another one of said two conducting pieces extends toward an upper portion of said interior of said housing so as to locate under said tongue of said upper casing, with said another one of said two conducting pieces capable of being caused to move downwards by said tongue.

8. The shoe warning light device of claim 1 wherein said rear wall of said housing is provided with an inverted corner.

9. The shoe warning light device of claim wherein said housing is provided with a twisting projection.

* * * * *